US007446746B2

(12) United States Patent
Bu et al.

(10) Patent No.: US 7,446,746 B2
(45) Date of Patent: Nov. 4, 2008

(54) METHOD FOR DETECTING WHETHER OR NOT DISPLAY MODE HAS TO BE SWITCHED

(75) Inventors: Lin-Kai Bu, Shanhua Township, Tainan County (TW); Kuei-Hsiang Chen, Shanhua Township, Tainan County (TW); Pen-Hsin Chen, Shanhua Township, Tainan County (TW); Ming-Yeong Chen, Shanhua Township, Tainan County (TW)

(73) Assignee: Himax Technologies Limited, Tainan (TW)

( * ) Notice: Subject to any disclaimer, the term of this patent is extended or adjusted under 35 U.S.C. 154(b) by 833 days.

(21) Appl. No.: 10/850,008

(22) Filed: May 20, 2004

(65) Prior Publication Data

US 2005/0001829 A1 Jan. 6, 2005

(30) Foreign Application Priority Data

Jun. 5, 2003 (TW) ..... 92115307 A

(51) Int. Cl.
*G09G 3/36* (2006.01)

(52) U.S. Cl. ..... 345/96; 345/209; 345/54; 345/58

(58) Field of Classification Search ..... 345/96, 345/94, 89, 209, 54, 58, 87; 348/226
See application file for complete search history.

(56) References Cited

U.S. PATENT DOCUMENTS

2001/0004253 A1* 6/2001 Fukutoku et al. ..... 345/96

* cited by examiner

*Primary Examiner*—Sumati Lefkowitz
*Assistant Examiner*—Seokyun Moon
(74) *Attorney, Agent, or Firm*—Thomas, Kayden, Horstemeyer & Risley

(57) ABSTRACT

A method for detecting whether or not a display mode has to be switched and for detecting a frame of a liquid crystal display panel. The frame has M vertical blocks each including K display lines each having N horizontal blocks each being composed of multiple display units. First, a horizontal block flag value of each horizontal block is obtained according to energy levels of all of the display units of the horizontal block. Then, a display line flag value of each display line is obtained according to horizontal block flag values of all of the horizontal blocks of the display line. Next, M vertical block flag values are obtained according to the display line flag values of all of the display lines in each vertical block. Then, it is determined whether or not the display mode has to be switched according to the M vertical block flag values.

28 Claims, 5 Drawing Sheets

| | | | | | |
|---|---|---|---|---|---|
| + | − | + | − | + | − |
| + | − | + | − | + | − |
| − | + | − | + | − | + |
| − | + | − | + | − | + |
| + | − | + | − | + | − |
| + | − | + | − | + | − |

(i)th frame

⟹

| | | | | | |
|---|---|---|---|---|---|
| − | + | − | + | − | + |
| − | + | − | + | − | + |
| + | − | + | − | + | − |
| + | − | + | − | + | − |
| − | + | − | + | − | + |
| − | + | − | + | − | + |

(i+1)th frame

FIG. 4(PRIOR ART)

| | | | | | |
|---|---|---|---|---|---|
| Line(1) | HB1(1) [FHB1(1)] | HB1(2) [FHB1(2)] | HB1(3) [FHB1(3)] | ····· | HB1(N) [FHB1(N)] |
| Line(2) | HB2(1) [FHB2(1)] | HB2(2) [FHB2(2)] | HB2(3) [FHB2(3)] | ····· | HB2(N) [FHB2(N)] |

FIG. 5A

| | | | | |
|---|---|---|---|---|
| SLine(1) | SHB1(1) | SHB1(2) | ..... | SHB1(c) |
| SLine(2) | SHB2(1) | SHB2(2) | ..... | SHB2(c) |

METHOD FOR DETECTING WHETHER OR NOT DISPLAY MODE HAS TO BE SWITCHED

This application claims the benefit of Taiwan application Serial No. 92115307, filed Jun. 5, 2003. The subject matter of which is incorporated herein by reference.

BACKGROUND OF THE INVENTION

1. Field of the Invention

The invention relates to a method for detecting whether or not a display mode has to be switched, and more particularly to a method for detecting whether or not a display mode has to be switched, which is adopted in a liquid crystal display panel.

2. Description of the Related Art

Since the liquid crystal display (LCD) is advantageously thin in volume, light in weight and has low electromagnetic radiation, it is widely used recently. It is an important subject of the manufacturer as to how to reduce the cost of the liquid crystal display and increase the product competitiveness.

The conventional liquid crystal display panel is mainly composed of a top substrate, a bottom substrate, and a liquid crystal layer interposed therebetween. A common electrode is formed on a bottom surface of the top substrate, and a thin film transistor (TFT) for controlling a pixel electrode is formed on a top surface of the bottom substrate. Liquid crystal molecules in the liquid crystal layer change their tilts according to a voltage difference between the common electrode and the pixel electrode. The liquid crystal molecules with different tilts have different transmission rates with respect to a light ray, and enable display units on the liquid crystal display panel to display different brightness corresponding to different gray-scale values.

FIG. 1 is a graph showing a relationship between voltages of a common electrode and a pixel electrode in an ideal condition. It is assumed that the voltage of the common electrode is a common voltage Vcom, and the voltage of the pixel electrode may be a positive polarity voltage V+ or a negative polarity voltage V−. The tilts of the liquid crystal molecules only relate to a voltage difference between the common electrode and the pixel electrode. Hence, as long as a difference Vg1 between the positive polarity voltage V+ and the common voltage Vcom equals to the difference Vg2 between the common voltage Vcom and the negative polarity voltage V−, the display units display the same brightness when the positive polarity voltage V+ and the negative polarity voltage V− are input to the pixel electrode. In order to protect the liquid crystal molecules, the positive polarity voltage V+ and the negative polarity voltage V− have to be alternately input to the pixel electrode.

FIG. 2 is a schematic illustration showing a liquid crystal display panel using a dot inversion display mode. When the liquid crystal display panel is driven under the dot inversion display mode, the image quality is better than that of any other display mode. In FIG. 2, each grid represents a display unit, which may be a red, green or blue display unit, wherein the sign "+" represents a display unit with positive polarity, and the sign "−" represents a display unit with negative polarity. The positive polarity voltage V+ is applied to the pixel electrode in the display unit with positive polarity, and the negative polarity voltage V− is applied to the pixel electrode in the display unit with negative polarity. The display method for the dot inversion display mode is such that adjacent display units have different polarities when the (i)th frame is displayed, and the polarities of all display units are switched to different polarities when the (i+1)th frame is displayed.

However, when the common voltage Vcom is drifted, the phenomenon of display flicker may occur. The reason is described in the following. FIG. 3 is a graph showing a relationship between voltages of a common electrode and a pixel electrode in a practical condition. Even though the positive polarity voltage V+ and the negative polarity voltage V− corresponding to the same gray-scale value are input to the pixel electrode, the drifted common voltage Vcom makes the difference Vg1' between the positive polarity voltage V+ and the common voltage Vcom and the difference Vg2' between the common voltage Vcom and the negative polarity voltage V− different from each other, and also makes the brightness of the display units different from each other. With regard to the same display unit, although the same gray-scale value is represented, different brightness may occur in the (i)th frame and the (i+1)th frame, thereby causing the phenomenon of frame flicker.

Particularly, when the property of some of the displayed frames meet specific patterns, the phenomenon of frame flicker will be more conspicuous. Conventionally, the displayed frames and the specific patterns are compared first. If the displayed frames have the specific patterns, the display mode of the liquid crystal display panel is switched to a two-line dot inversion display mode in order to ease the phenomenon of frame flicker. The display method for the two-line dot inversion display mode is described in the following. FIG. 4 is a schematic illustration showing a liquid crystal display panel using a two-line dot inversion display mode. When the (i)th frame is displayed, adjacent display units in the same row are alternately arranged as one positive polarity display unit and one negative polarity display unit, and the display units in the same column are alternately arranged as two positive polarity display units and two negative polarity display units. When the (i+1)th frame is displayed, the polarities of all display units are switched to different polarities.

However, the conventional method has the following drawbacks. Since the conventional method for detecting the flicker pattern compares fixed patterns with the displayed frames, the images of the red, green and blue display units have to be separated for comparison. Thus, the required operation load is very high and the required hardware area is also large. It is therefore an important subject to reduce the operation load and the hardware area.

SUMMARY OF THE INVENTION

In view of the above-mentioned problems, it is therefore an object of the invention to provide a method for detecting whether or not a display mode has to be switched, wherein the viewpoint of the energy value and the positive/negative polarity of each display unit is introduced to detect whether or not the displayed frames meet the property of the flicker frame. The invention may complete the detection operation by only one calculation. The invention also may effectively achieve the object of reducing the operation load and the required hardware area.

The invention achieves the above-identified object by providing a method for detecting whether or not a display mode has to be switched. The method is performed to detect a frame of a liquid crystal display panel. The frame is displayed under a first display mode and has M vertical blocks. Each of the vertical blocks includes K display lines. Each of the display lines has N horizontal blocks, each of which is composed of multiple display units. Each of the horizontal blocks corresponds to a horizontal block energy value and a horizontal block flag value, each of the display lines corresponds to a display line energy value and a display line flag value, and each of the vertical blocks corresponds to a vertical block energy value and a vertical block flag value. The method of the invention includes the following steps. First, a step (a) is performed to obtain the horizontal block energy value of each of the horizontal blocks according to a sum of energy levels of all of the display units in each of the horizontal blocks. Then, a step (b) is performed to obtain the horizontal block flag value of each of the horizontal blocks by comparing the horizontal block energy value of each of the horizontal blocks to a horizontal block threshold value, respectively, wherein each of the horizontal block flag values is used to identify a polarity of the corresponding horizontal block. Next, a step (c) is performed to obtain the display line energy value of each of the display lines according to a sum of the horizontal block flag values of all of the horizontal blocks in each of the display lines. Then, a step (d) is performed to obtain the display line flag value of each of the display lines by comparing the display line energy value of each of the display lines to a display line threshold value respectively. Next, a step (e) is performed to obtain the M vertical block energy values according to the display line flag values of all of the display lines in each of the vertical blocks. Then, a step (f) is performed to obtain the M vertical block flag values by comparing the vertical block energy value of each of the vertical blocks to a vertical block threshold value. Subsequently, a step (g) is performed to calculate a sum of the M vertical block flag values and comparing the sum of the M vertical block flag values to a frame threshold value to determine whether or not the first display mode has to be switched to a second display mode.

The invention also achieves the above-identified object by providing a method for detecting whether or not a display mode has to be switched and for detecting a frame of a liquid crystal display panel. The frame has M vertical blocks each including K display lines. Each display line has N horizontal blocks, each of which is composed of multiple display units. Each horizontal block corresponds to a horizontal block flag value, each display line corresponds to a display line flag value, and each vertical block corresponds to a vertical block flag value. The method includes the following steps. First, a step (a') is performed to obtain the horizontal block flag value of each of the horizontal blocks according to energy levels of all of the display units in each of the horizontal blocks. Then, a step (b') is performed to obtain the display line flag value of each of the display lines according to the horizontal block flag values of all of the horizontal blocks in each of the display lines. Next, a step (c') is performed to obtain the M vertical block flag values according to the display line flag values of all of the display lines in each of the vertical blocks. Then, a step (d') is performed to determine whether or not the display mode has to be switched according to the M vertical block flag values.

The invention also achieves the above-identified object by providing a method for detecting whether or not a display mode has to be switched and for detecting a frame of a liquid crystal display panel. The frame is displayed under a first display mode and has a plurality of frame blocks, each of the frame blocks has NA vertical blocks, each of the vertical blocks includes NB display lines, each of the display lines has NC horizontal blocks, each of the horizontal blocks is composed of a plurality of display units. Each of the horizontal blocks corresponds to a horizontal block flag value, each of the display lines corresponds to a display line flag value, and each of the vertical blocks corresponds to a vertical block flag value. The method includes the following steps. First, a step (a") is performed to obtain the horizontal block flag value of each of the horizontal blocks according to energy levels of all of the display units in each of the horizontal blocks. Next, a step (b") is performed to obtain the display line flag value of each of the display lines according to the horizontal block flag values of all of the horizontal blocks in each of the display lines. Then, a step (c") is performed to obtain the vertical block flag value of each of the vertical blocks according to the display line flag values of all of the display lines in each of the vertical blocks. Next, a step (d") is performed to determine whether or not each of the frame blocks satisfies a condition of switching the display mode according to all of the vertical block flag values in each of the vertical blocks, wherein if a fixed number of frame blocks satisfies the condition of switching the display mode, the liquid crystal display panel is switched to a second display mode.

Other objects, features, and advantages of the invention will become apparent from the following detailed description of the preferred but non-limiting embodiments. The following description is made with reference to the accompanying drawings.

BRIEF DESCRIPTION OF THE DRAWINGS

FIG. 4 is a schematic illustration showing a liquid crystal display panel using a two-line dot inversion display mode.

FIGS. 5A to 5B are schematic illustrations showing first frame structures in a method for detecting whether or not a display mode has to be switched according to a preferred embodiment of the invention.

DETAILED DESCRIPTION OF THE INVENTION

The spirit of the method of the invention for detecting whether or not a display mode has to be switched is characterized in that the viewpoint of the energy value and the positive/negative polarity of each display unit is introduced to detect whether or not the displayed frames meet the property of the flicker frame. The invention only has to calculate the energy value and the flag value, and compare the calculated energy value and the flag value to the threshold value specified in correspondence with the human vision system (HVS). Therefore, it is possible to judge whether or not the frame has the pattern that may cause frame flicker, and then to determine whether or not the display mode has to be switched to a different mode in order to eliminate the phenomenon of frame flicker.

Figure 1:
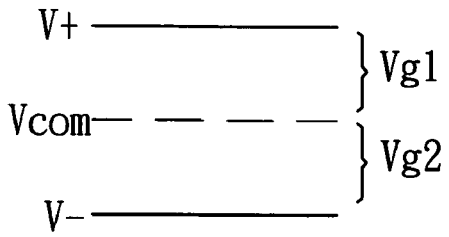
FIG. 1(PRIOR ART)
FIG. 1 is a graph showing a relationship between voltages of a common electrode and a pixel electrode in an ideal condition.
Figure 2:
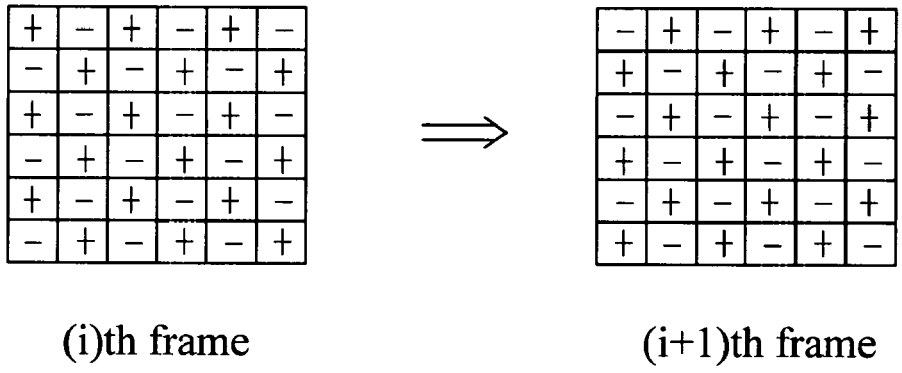
FIG. 2(PRIOR ART)
FIG. 2 is a schematic illustration showing a liquid crystal display panel using a dot inversion display mode.
Figure 3:
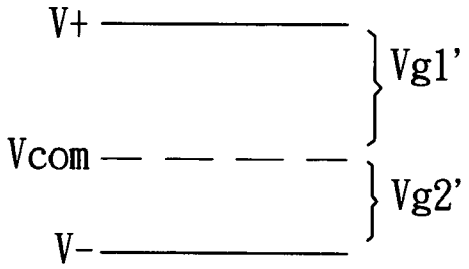
FIG. 3(PRIOR ART)
FIG. 3 is a graph showing a relationship between voltages of a common electrode and a pixel electrode in a practical condition.
Figure 5B:
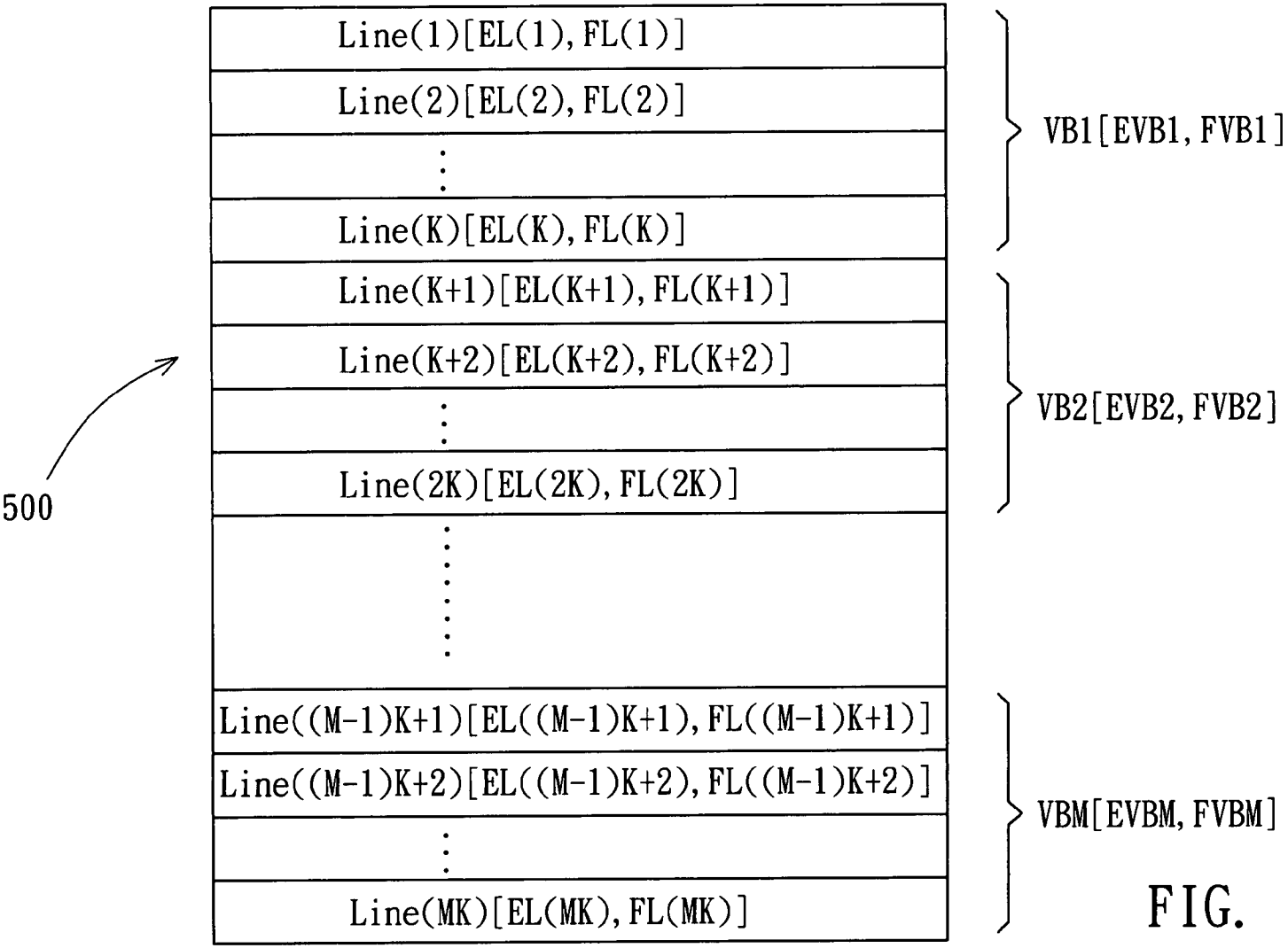

FIGS. 5A to 5B are schematic illustrations showing first frame structures in a method for detecting whether or not a display mode has to be switched according to a preferred embodiment of the invention. The invention is used to detect a frame 500 of a liquid crystal display panel. The frame 500 is typically displayed under a dot inversion display mode. As shown in FIG. 5B, the frame 500 has M vertical blocks VB (VB1 to VBM). Each of the vertical blocks VB includes K display lines Line. For example, the vertical block VB1 includes display lines Line(1) to Line(K). As shown in FIG. 5A, each of the display lines has N horizontal blocks HB. For example, the display line Line(1) has horizontal blocks HB1 (1) to HB1 (N), and the display line Line(2) has horizontal blocks HB2(1) to HB2(N). Each of the horizontal blocks is composed of multiple display units. For example, each of the horizontal blocks is composed of four display units.

Each of the horizontal blocks HB corresponds to a horizontal block energy value EHB and a horizontal block flag value FHB. Each of the display lines Line corresponds to a display line energy value EL and a display line flag value FL, and each of the vertical blocks VB corresponds to a vertical block energy value EVB and a vertical block flag value FVB.

FIRST EMBODIMENT

The method for detecting whether or not a display mode has to be switched according to a first embodiment of the invention will be described in the following. As shown in FIG. 5A, a step (a) is performed to map the gray scale value of each display unit in each horizontal block HB to an energy level, and to calculate a sum of the energy levels of all of the display units in each horizontal block HB to obtain the horizontal block energy value EHB of each horizontal block HB. If 256 gray scale values may map to 16 energy levels, an absolute value of the corresponding energy level gets greater as the gray scale value gets greater. When the positive polarity voltage V+ is input to the display unit, the energy level of the display unit is a positive value. When the negative polarity voltage V− is input to the display unit, the energy level of the display unit is a negative value.

Then, a step (b) is performed to compare the horizontal block energy value EHB of each horizontal block HB to a horizontal block threshold value EHB_TH, respectively, to obtain the horizontal block flag value FHB of each horizontal block. The relationship between the horizontal block flag value FHB and the horizontal block energy value EHB is as follows:

$$FHB=+1\text{(positive polarity), if } EHB>=|EHB_TH|;$$

$$FHB=-1\text{(negative polarity), if } EHB<=-|EHB_TH|; \text{ and}$$

$$FHB=0\text{ (nonpolarity), otherwise} \qquad \text{(Equation 1)},$$

wherein |EHB_TH| represents the absolute value of the horizontal block threshold value EHB_TH. Each horizontal block flag value FHB is used to identify the polarity of the corresponding horizontal block HB.

Next, a step (c) is performed to obtain the display line energy value EL of each display line Line according to a sum of the horizontal block flag values FHB of all of the horizontal blocks HB in each display line Line.

Then, a step (d) is performed to obtain the display line flag value FL of each display line EL by comparing the display line energy value EL of each display line EL to a display line threshold value EL_TH, respectively, wherein the relationship between the display line flag value FL and the display line energy value EL is as follows:

$$FL=+1\text{(positive polarity), if } EL>=|EL_TH|;$$

$$FL=-1\text{(negative polarity), if } EL<=-|EL_TH|; \text{ and}$$

$$FL=0\text{(nonpolarity), otherwise} \qquad \text{(Equation 2)},$$

wherein |EL_TH| represents the absolute value of the display line threshold value EL_TH. Each display line flag value FL is used to identify the polarity of the corresponding display line Line.

Next, a step (e) is performed to obtain M vertical block energy values EVB according to the display line flag values FL of all display lines Line in each vertical block VB. The M vertical block energy values EVB are obtained by subtracting a sum of the display line flag values FL of all even-numbered display lines Line from a sum of the display line flag values FL of all odd-numbered display lines Line in each vertical block.

Then, a step (f) is performed to obtain the M vertical block flag values FVB by comparing the vertical block energy value EVB of each vertical block VB to a vertical block threshold value EVB_TH, respectively, wherein the relationship between the vertical block flag value FVB and the vertical block energy value EVB is as follows:

$$FVB=+1\text{(positive polarity), if } EVB>=|EVB_TH|;$$

$$FVB=-1\text{(negative polarity), if } EVB<=-|EVB_TH|; \text{ and}$$

$$FVB=0\text{(nonpolarity), otherwise} \qquad \text{(Equation 3)},$$

wherein |EL_TH| represents the absolute value of the display line threshold value EL_TH. Each display line flag value FL is used to identify the polarity of the corresponding display line Line.

Next, a step (g) is performed to calculate a sum Sum of the M vertical block flag values FVB, and compare the sum Sum to a frame threshold value F_TH to determine whether or not a first display mode has to be switched to a second display mode. When the sum Sum is greater than the frame threshold value F_TH, the liquid crystal display panel displays a next frame under a two-line dot inversion display mode.

An example will be provided to describe the method of the invention.

First, the horizontal block HB1(1) is taken as an example. If the horizontal block HB1 (1) has display units (1) to (4), and the gray-scale values of the display units (1) to (4) correspond to the energy levels of +16, −2, +9 and −5, respectively, the horizontal block energy value EHB1 (1) of the horizontal block HB1 (1) is 16+(−2)+(+9)+(−5)=+18. Since the frame 500 is driven under the dot inversion display mode, the energy levels of the display units (1) to (4) appear in one positive sign and one negative sign alternately.

If the horizontal block threshold value EHB_TH is 16, the horizontal block flag value FHB1(1) of the horizontal block HB1(1) with the horizontal block energy value EHB1(1) of +18 equals to +1. After the horizontal block energy values EHB and the horizontal block flag values FHB of all of the horizontal blocks HB1 are calculated, the display line energy values EL and the display line flag values FL of all of the display lines Line may be calculated.

Now, the display line Line(1) will be taken as an example again. The display line energy value EL(1) of the display line Line(1) as follows:

$$EL(1)=FHB1(1)+FHB1(2)+FHB1(3)+\ldots+FHB1(N).$$

Then, after the display line energy values EL of all of the display lines Line are obtained followed by the judgement of Equation 2, it is possible to obtain the display line flag values FL of all of the display lines Line. Subsequently, the vertical block energy value EVB of each vertical block VB may be calculated. Now, the vertical block VB1 will be taken as an example. The vertical block energy value EVB1 equals to FL(1)−FL(2)+FL(3)−FL(4)+ . . . +FL(K). After the vertical block energy values EVB of all of the vertical blocks VB are obtained, it is possible to obtain the vertical block flag values FVB1 to FVBM of the vertical blocks VB1 to VBM according to Equation 3.

Next, the value of the sum (Sum=FVB 1+FVB 2+ . . . +FVBM) is calculated. If the sum Sum is greater than the frame threshold value F_TH, the liquid crystal display panel displays a next frame under the two line dot inversion display mode. If not, the liquid crystal display panel still displays a next frame under the dot inversion display mode.

When the liquid crystal display panel is changed to display the next frame under the two-line dot inversion display mode, it is still possible to use the inverse operation mode of the first embodiment to determine whether or not the liquid crystal display panel has to return to the original dot inversion display mode to display the next frame. That is, the steps (a) to (g) in the first embodiment may be implemented to show the frames under the two-line dot inversion display mode. When the sum Sum obtained in the step (g) is smaller than the frame threshold value F_TH, the liquid crystal display panel returns to show the next frame under the dot inversion display mode.

However, if there is too much noise interference in the system, the display mode of the liquid crystal display panel is frequently switched between the dot inversion display mode and the two-line dot inversion display mode. The frequent switching operations may also cause the frame flicker. In order to avoid such a problem, the method of the invention for determining whether or not the display mode has to be switched may be performed one time after P frames are displayed under the dot inversion display mode so as to determine whether or not the original dot inversion display mode has to be switched to the two-line dot inversion display mode. After the display mode has been switched to the two-line dot inversion display mode, the method of the invention for determining whether or not the display mode has to be switched may be performed one time after Q frames are displayed under the two-line dot inversion display mode so as to determine whether or not the original two-line dot inversion display mode has to be switched to the dot inversion display mode. Consequently, the problem of frequent switching operations caused by noise may be solved, wherein P and Q may be positive integers, which are the same as or different from each other.

In addition, it is also possible to detect whether or not the parameters used under the dot inversion display mode have to be recovered. If the threshold values of all of the parameters become smaller, the principle of approximately delayed effects may be utilized to reduce the problem caused by the noise.

For the sake of clearly illustrating the invention, the horizontal block threshold value FHB_TH, the display line threshold value FL_TH, the vertical block threshold value FVB_TH and the frame threshold value F_TH, which are used to detect whether or not the dot inversion display mode has to be switched to the two-line dot inversion display mode, are redefined as a first horizontal block threshold value FHB_TH1, a first display line threshold value FL_TH1, a first vertical block threshold value FVB_TH1, and a first frame threshold value F_TH1, respectively. The horizontal block threshold value FHB_TH, the display line threshold value FL_TH, the vertical block threshold value FVB_TH and the frame threshold value F_TH, which are used to detect whether or not the two-line dot inversion display mode has to be switched to the dot inversion display mode, are redefined as a second horizontal block threshold value FHB_TH2, a second display line threshold value FL_TH2, a second vertical block threshold value FVB_TH2 and a second frame threshold value F_TH2, respectively. The first horizontal block threshold value FHB_TH1 is greater than the second horizontal block threshold value FHB_TH2, the first display line threshold value FL_TH1 is greater than the second display line threshold value FL_TH2, the first vertical block threshold value FVB_TH1 is greater than the second vertical block threshold value FVB_TH2, and the first frame threshold value F_TH1 is greater than the second frame threshold value F_TH2.

The method of the invention for detecting whether or not a display mode has to be switched is applicable to detecting whether or not the original dot inversion display mode has to be switched to the two-line dot inversion display mode so as to solve the phenomenon of display flicker caused by the drift of the common voltage Vcom. In addition, the invention is also applicable to detecting whether or not the original dot inversion display mode has to be switched to any other display mode with less display flicker phenomenon, which may be, for example, an I-line J-dot inversion display mode, wherein I and J are positive integers.

The so-called I-line J-dot inversion display mode means that, in a (k)th frame, adjacent display units in the same row are alternately arranged as J positive polarity display units and J negative polarity display units, and the display units in the same column are alternately arranged as I positive polarity display units and I negative polarity display units. When the (k+1)th frame is displayed, the polarities of all display units are switched to different polarities.

Figure 6:
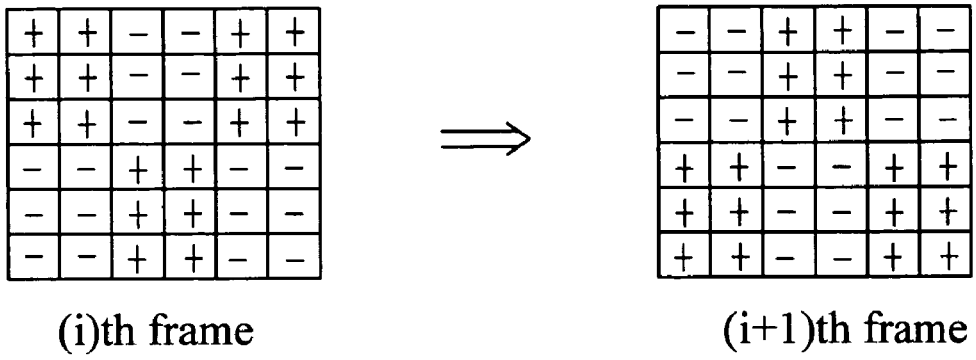
FIG. 6 is a schematic illustration showing a liquid crystal display panel using a three-line-two-dot inversion display mode.

A three-line-two-dot inversion display mode having I=3 and J=2 will be taken as an example for illustration. FIG. 6 is a schematic illustration showing a liquid crystal display panel using a three-line-two-dot inversion display mode. When the (i)th frame is displayed, adjacent display units in the same row are alternately arranged as two positive polarity display units and two negative polarity display units, and the display units in the same column are alternately arranged as three positive polarity display units and three negative polarity display units. When the (i+1)th frame is displayed, the polarities of all display units are switched to different polarities.

Similarly, all threshold values used to detect whether or not the dot inversion display mode has to be switched to the I-line J-dot inversion display mode also may be greater than those used to detect whether or not the I-line J-dot inversion display mode has to be switched to the dot inversion display mode.

In addition, if the operation load has to be further reduced, it is possible to apply the method to the display units with the same color in one frame. For example, it is possible to apply this method to all of the red display units, green display units or blue display units in one frame. Furthermore, the method may be applied to display units with different colors in different frames.

SECOND EMBODIMENT

The flag value of the invention may be obtained by comparing the sum of energy values to the threshold value in the first embodiment, and also may be obtained by comparing another threshold value to a ratio of the negative polarity parameter to the positive polarity parameter.

The method for detecting whether or not a display mode has to be switched according to a second embodiment of the invention is used to detect a frame of a liquid crystal display panel. The frame has M vertical blocks, each of which includes K display lines, each of which has N horizontal blocks, each of which is composed of a plurality of display units. Each horizontal block corresponds to a horizontal block flag value, each display line corresponds to a display line flag value, and each vertical block corresponds to a vertical block flag value.

The method according to the second embodiment of the invention includes the following steps. First, a step (a') is performed to obtain the horizontal block flag value of each horizontal block according to the energy levels of all of the display units in each horizontal block. The energy level of the positive polarity display unit is a positive energy level, and the energy level of the negative polarity display unit is a negative energy level. In this step, the horizontal block flag value of each horizontal block is obtained according to a ratio of a sum of the energy levels of all of the display units with the negative energy levels to a sum of the energy levels of all of the display units with the positive energy levels in each horizontal block.

Next, a step (b') is performed to obtain the display line flag value of each display line according to the horizontal block flag values of all horizontal blocks in each display line, wherein the horizontal block flag values may be positive or negative. In this step, the display line flag value of each display line is obtained according to a ratio of a sum of all of the negative horizontal block flag values to a sum of all of the positive horizontal block flag values in each display line.

Then, a step (c') is performed to obtain M vertical block flag values according to the display line flag values of all of the display lines in each vertical block, wherein the display line flag values may be positive or negative. In this step (c'), the M vertical block flag values are obtained according to a ratio of the sum of all of the negative display line flag values to the sum of all of the positive display line flag values in each vertical block.

Next, a step (d') is performed to determine whether or not the display mode has to be switched according to M vertical block flag values, wherein the M vertical block flag values may be positive or negative. In this step (d"), whether or not the display mode has to be switched is determined according to a ratio of the sum of all negative vertical block flag values to the sum of all positive vertical block flag values. When this ratio is greater than a frame threshold value, the display mode has to be switched.

THIRD EMBODIMENT

Furthermore, the invention may first divide the frame into multiple frame blocks, and then perform the steps of the first embodiment in each frame block. The method of the third embodiment may advantageously and precisely detect whether or not a pattern, which may cause the frame flicker, exists in the frame because some patterns, which may cause the frame flicker, may be localized.

Figure 7A:
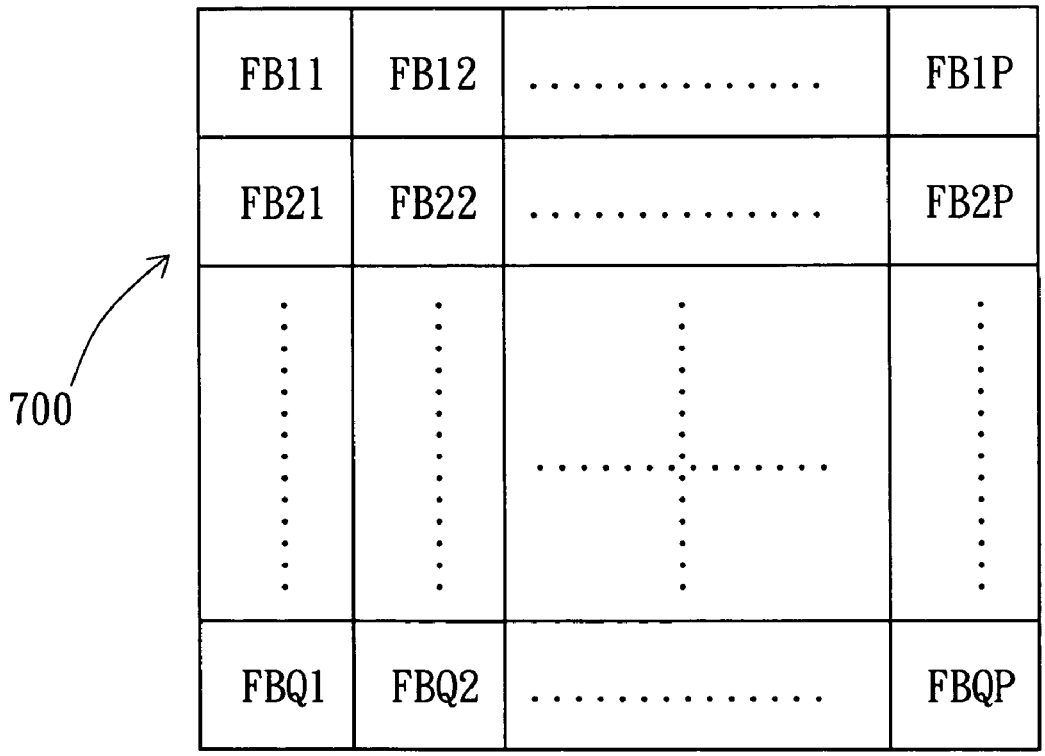
FIGS. 7A to 7C are schematic illustrations showing second frame structures in a method for detecting whether or not a display mode has to be switched according to a third embodiment of the invention.
Figures 7B, 7C:
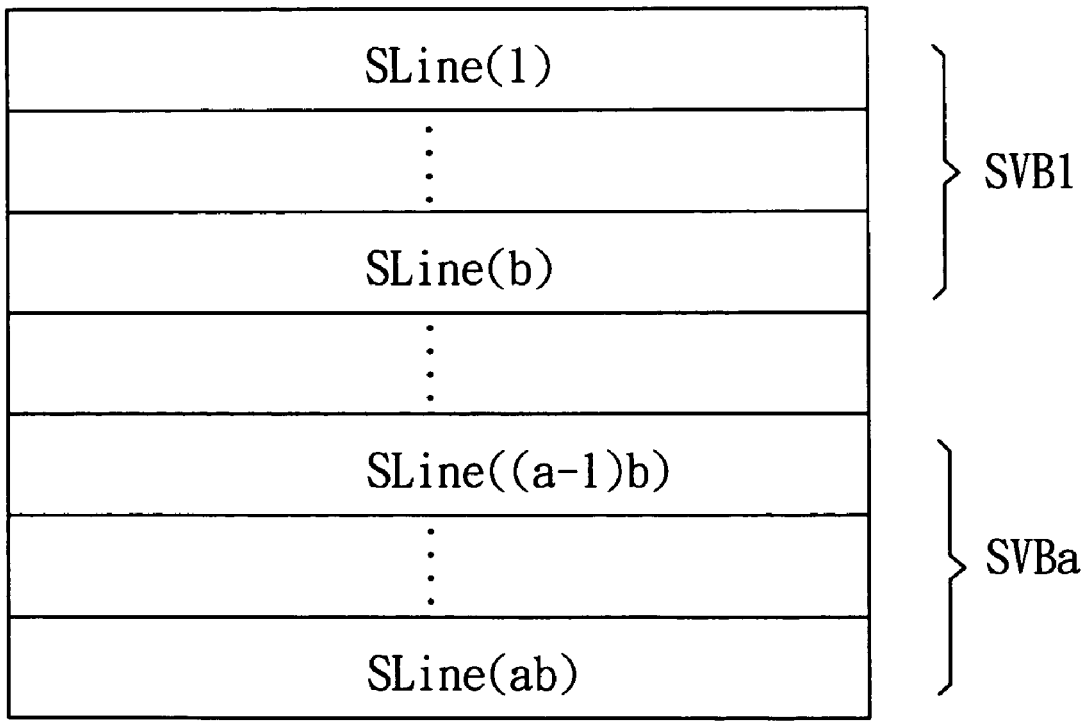

FIGS. 7A to 7C are schematic illustrations showing second frame structures in a method for detecting whether or not a display mode has to be switched according to a third embodiment of the invention. The method for detecting whether or not a display mode has to be switched according to then third embodiment of the invention is used to detect a frame 700 of a liquid crystal display panel. The frame 700 is displayed under a first display mode, such as the dot inversion display mode. The frame has P*Q frame blocks, such as the frame blocks FB11, FB12, . . . , FBQP. Each frame block FB has NA vertical blocks, such as vertical blocks SVB1 to SVBa as shown in FIG. 7C. Each vertical block SVB includes NB display lines. For example, the vertical block SVB1 is composed of multiple display lines SLine(1) to SLine(b). Each display line SLine has NC horizontal blocks. For example, as shown in FIG. 7B, the display line SLine(1) is composed of multiple horizontal blocks SHB1(1) to SHB1(c). Each horizontal block SHB1 is composed of multiple display units. Each horizontal block SHB corresponds to a horizontal block flag value FSHB, each display line SLine corresponds to a display line flag value FSLine, and each vertical block SVB corresponds to a vertical block flag value FSVB.

The method for detecting whether or not a display mode has to be switched according to the third embodiment of the invention includes the following steps. First, a step (a") is performed to obtain the horizontal block flag value FSHB of each horizontal block according to the energy levels of all of the display units in each horizontal block SHB. Then, a step (b") is performed to obtain the display line flag value FSLine of each display line SLine according to the horizontal block flag values FSHB of all of the horizontal blocks SHB in each display line SLine. Next, a step (c") is performed to obtain the vertical block flag value FSVB of each vertical block SVB according to the display line flag values FSLine of all of the display lines SLine in each vertical block SVB. Then, a step (d") is performed to determine whether or not each frame block FB satisfies the condition of switching the display mode according to all of the vertical block flag values FSVB in each vertical block SVB. If a fixed number (e.g., one or multiple) of frame block(s) satisfies the condition of switching the display mode, the liquid crystal display panel is switched to the two-line dot inversion display mode.

Each flag value of the third embodiment may be obtained using the method of the first embodiment to sum up the energy values and then compare the sum to the threshold value, or using the method of the second embodiment to determine a ratio of the sum of all of the negative flag values to the sum of all of the positive flag values. In addition, the first display mode also may be the two-line dot inversion display mode, and the second display mode also may be the dot inversion display mode. More particularly, the first display mode or the second display mode also may be the I-line J-dot inversion display mode.

In the method for detecting whether or not a display mode has to be switched according to the above mentioned embodiments of the invention, the overall frame is divided into multiple horizontal blocks, display lines and vertical blocks, and the energy value of each display unit, the energy values of the horizontal blocks, display lines and vertical blocks, and the flag values representing positive/negative polarities are introduced to detect whether or not the displayed frame meets the property of the flicker frame. The invention only needs one time of calculation to complete the detecting operation. Therefore, the invention may effectively achieve the object of reducing the calculation load and the required hardware area.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for detecting whether or not a display mode has to be switched and for detecting a frame of a liquid crystal display panel, the frame being displayed under a first display mode and having M vertical blocks, each of which comprising K display lines, each of which having N horizontal blocks, each of which being composed of a plurality of display units, each of the horizontal blocks corresponding to a horizontal block energy value and a horizontal block flag value, each of the display lines corresponding to a display line energy value and a display line flag value, each of the vertical blocks corresponding to a vertical block energy value and a vertical block flag value, M, K, and N being positive integers, and the method comprising the steps of:

(a) obtaining the horizontal block energy value of each of the horizontal blocks according to a sum of energy levels of all of the display units in each of the horizontal blocks;

(b) obtaining the horizontal block flag value of each of the horizontal blocks by comparing the horizontal block energy value of each of the horizontal blocks to a horizontal block threshold value, respectively, wherein each of the horizontal block flag values is used to identify a polarity of the corresponding horizontal block;

(c) obtaining the display line energy value of each of the display lines according to a sum of the horizontal block flag values of all of the horizontal blocks in each of the display lines;

(d) obtaining the display line flag value of each of the display lines by comparing the display line energy value of each of the display lines to a display line threshold value, respectively;

(e) obtaining the M vertical block energy values according to the display line flag values of all of the display lines in each of the vertical blocks;

(f) obtaining the M vertical block flag values by comparing the vertical block energy value of each of the vertical blocks to a vertical block threshold value; and (g) calculating a sum of the M vertical block flag values and comparing the sum of the M vertical block flag values to a frame threshold value to determine whether or not the first display mode has to be switched to a second display mode.

2. The method according to claim 1, wherein in the step (e), the M vertical block energy values are obtained according to a difference obtained by subtracting a sum of the display line flag values of all of the even-numbered display lines from a sum of the display line flag values of all of the odd-numbered display lines.

3. The method according to claim 1, wherein in the step (g), when the sum is greater than the frame threshold value, the liquid crystal display panel displays a next frame under the second display mode.

4. The method according to claim 1, wherein the first display mode is a dot inversion display mode and the second display mode is a two-line dot inversion display mode.

5. The method according to claim 1, wherein:

the first display mode is either a dot inversion display mode or a two-line dot inversion display mode, and the second display mode also is either the dot inversion display mode or the two-line dot inversion display mode;

when the first display mode is the dot inversion display mode and the second display mode is the two-line dot inversion display mode, the horizontal block threshold value, the display line threshold value, the vertical block threshold value and the frame threshold value are a first horizontal block threshold value, a first display line threshold value, a first vertical block threshold value and a first frame threshold value, respectively;

when the first display mode is the two-line dot inversion display mode and the second display mode is the dot inversion display mode, the horizontal block threshold value, the display line threshold value, the vertical block threshold value and the frame threshold value are a second horizontal block threshold value, a second display line threshold value, a second vertical block threshold value and a second frame threshold value, respectively; and the first horizontal block threshold value is greater than the second horizontal block threshold value, the first display line threshold value is greater than the second display line threshold value, the first vertical block threshold value is greater than the second vertical block threshold value, and the first frame threshold value is greater than the second frame threshold value.

6. The method according to claim 1, wherein the first display mode is a dot inversion display mode, the second display mode is an I-line J-dot inversion display mode, and I and J are positive integers.

7. The method according to claim 1, wherein:

the first display mode is either a dot inversion display mode or an I-dot J-line inversion display mode, and the second display mode also is either the dot inversion display mode or the I-dot J-line inversion display mode, wherein I and J are positive integers;

when the first display mode is the dot inversion display mode and the second display mode is the I-dot J-line inversion display mode, the horizontal block threshold value, the display line threshold value, the vertical block threshold value and the frame threshold value are a first horizontal block threshold value, a first display line threshold value, a first vertical block threshold value and a first frame threshold value, respectively;

when the first display mode is the I-dot J-line inversion display mode and the second display mode is the dot inversion display mode, the horizontal block threshold value, the display line threshold value, the vertical block threshold value and the frame threshold value are a second horizontal block threshold value, a second display line threshold value, a second vertical block threshold value and a second frame threshold value; and the first horizontal block threshold value is greater than the second horizontal block threshold value, the first display line threshold value is greater than the second display line threshold value, the first vertical block threshold value is greater than the second vertical block threshold value, and the first frame threshold value is greater than the second frame threshold value.

8. The method according to claim 1, wherein all of the display units are red, green, or blue display units.

9. The method according to claim 1, wherein:

the first display mode is either a dot inversion display mode or an I-dot J-line inversion display mode, and the second display mode also is either the dot inversion display mode or the I-dot J-line inversion display mode, wherein I and J are positive integers;

when the first display mode is the dot inversion display mode and the second display mode is the I-dot J-line inversion display mode, the liquid crystal display panel performs the method one time to determine whether or not the first display mode has to be switched to the second display mode after P frames are displayed under the first display mode; and when the first display mode is the I-dot J-line inversion display mode and the second display mode is the dot inversion display mode, the liquid crystal display panel performs the method one time to determine whether or not the first display mode has to be switched to the second display mode after Q frames are displayed under the first display mode, and P and Q are positive integers.

10. A method for detecting whether or not a display mode has to be switched and for detecting a frame of a liquid crystal display panel, the frame having M vertical blocks, each of which including K display lines, each of which having N horizontal blocks, each of which being composed of a plurality of display units, each of the horizontal blocks corresponding to a horizontal block flag value, each of the display lines corresponding to a display line flag value, each of the vertical blocks corresponding to a vertical block flag value, M, K, and N being positive integers, and the method comprising the steps of:

(a') obtaining the horizontal block flag value of each of the horizontal blocks according to a sum of energy levels of all of the display units in each of the horizontal blocks;

(b') obtaining the display line flag value of each of the display lines according to the horizontal block flag values of all of the horizontal blocks in each of the display lines;

(c') obtaining the M vertical block flag values according to the display line flag values of all of the display lines in each of the vertical blocks; and (d') determining whether or not the display mode has to be switched according to the M vertical block flag values.

11. The method according to claim 10, wherein in the step (b'), the display line flag value of each of the display lines is obtained according to a sum of all of the horizontal block flag values in each of the display lines.

12. The method according to claim 10, wherein each of the horizontal block flag values is either a positive value or negative value, and in the step (b'), the display line flag value of each of the display lines is obtained according to a ratio of a sum of all of the negative horizontal block flag values to a sum of all of the positive horizontal block flag values in each of the display lines.

13. The method according to claim 10, wherein in the step (c'), the M vertical block flag values are obtained according to a difference obtained by subtracting a sum of the display line flag values of all of the even-numbered display lines from a sum of the display line flag values of all of the odd-numbered display lines in each of the vertical blocks.

14. The method according to claim 10, wherein each of the display line flag values is either a positive value or negative value, and in the step (c'), the M vertical block flag values of the M vertical blocks are obtained according to a ratio of a sum of all of the negative display line flag values to a sum of all of the positive display line flag values in each of the vertical blocks.

15. The method according to claim 10, wherein in the step (d'), whether or not the display mode has to be switched is determined according to a sum of the M vertical block flag values.

16. The method according to claim 10, wherein each of the M vertical block flag values is either a positive value or negative value, and in the step (d'), whether or not the display mode has to be switched according to a ratio of all of the negative vertical block flag values to a sum of all of the positive vertical block flag values.

17. A method for detecting whether or not a display mode has to be switched and for detecting a frame of a liquid crystal display panel, the frame being displayed under a first display mode and having a plurality of frame blocks, each of which having NA vertical blocks, each of which comprising NB display lines, each of which having NC horizontal blocks, each of which being composed of a plurality of display units, each of the horizontal blocks corresponding to a horizontal block flag value, each of the display lines corresponding to a display line flag value, each of the vertical blocks corresponding to a vertical block flag value, NA, NB, and NC being positive integers, and the method comprising the steps of:

(a") obtaining the horizontal block flag value of each of the horizontal blocks according to a sum of energy levels of all of the display units in each of the horizontal blocks;

(b") obtaining the display line flag value of each of the display lines according to the horizontal block flag values of all of the horizontal blocks in each of the display lines;

(c") obtaining the vertical block flag value of each of the vertical blocks according to the display line flag values of all of the display lines in each of the vertical blocks; and (d") determining whether or not each of the frame blocks satisfies a condition of switching the display mode according to all of the vertical block flag values in each of the vertical blocks, wherein if a fixed number of frame blocks satisfies the condition of switching the display mode, the liquid crystal display panel is switched to a second display mode.

18. The method according to claim 17, wherein the first display mode is a dot inversion display mode and the second display mode is a two-line dot inversion display mode.

19. The method according to claim 17, wherein the first display mode is a dot inversion display mode and the second display mode is an I-line J-dot inversion display mode, wherein I and J are positive integers.

20. A method for detecting whether or not a display mode has to be switched and for detecting a frame of a liquid crystal display panel, the frame having M vertical blocks, each of which including K display lines, each of which having N horizontal blocks, each of which being composed of a plurality of display units, each of the horizontal blocks corresponding to a horizontal block flag value, each of the display lines corresponding to a display line flag value, each of the vertical blocks corresponding to a vertical block flag value, M, K, and N being positive integers, and the method comprising the steps of:

(a') obtaining the horizontal block flag value of each of the horizontal blocks according to energy levels of all of the display units in each of the horizontal blocks, wherein each of the display units has either a positive energy level or negative energy level and the horizontal block flag value of each of the horizontal blocks is obtained according to a ratio of a sum of the negative energy levels of all of the display units to a sum of the positive energy levels of all of the display units in each of the horizontal blocks;

(b') obtaining the display line flag value of each of the display lines according to the horizontal block flag values of all of the horizontal blocks in each of the display lines;

(c') obtaining the M vertical block flag values according to the display line flag values of all of the display lines in each of the vertical blocks; and (d') determining whether or not the display mode has to be switched according to the M vertical block flag values.

21. The method according to claim 20, wherein in the step (b'), the display line flag value of each of the display lines is obtained according to a sum of all of the horizontal block flag values in each of the display lines.

22. The method according to claim 20, wherein each of the horizontal block flag values is either a positive value or negative value, and in the step (b'), the display line flag value of each of the display lines is obtained according to a ratio of a sum of all of the negative horizontal block flag values to a sum of all of the positive horizontal block flag values in each of the display lines.

23. The method according to claim 20, wherein in the step (c'), the M vertical block flag values are obtained according to a difference obtained by subtracting a sum of the display line flag values of all of the even-numbered display lines from a sum of the display line flag values of all of the odd-numbered display lines in each of the vertical blocks.

24. The method according to claim 20, wherein each of the display line flag values is either a positive value or negative value, and in the step (c'), the M vertical block flag values of the M vertical blocks are obtained according to a ratio of a sum of all of the negative display line flag values to a sum of all of the positive display line flag values in each of the vertical blocks.

25. The method according to claim 20, wherein in the step (d'), whether or not the display mode has to be switched is determined according to a sum of the M vertical block flag values.

26. The method according to claim 20, wherein each of the M vertical block flag values is either a positive value or negative value, and in the step (d'), whether or not the display mode has to be switched according to a ratio of all of the negative vertical block flag values to a sum of all of the positive vertical block flag values.

27. A method for detecting whether or not a display mode has to be switched and for detecting a frame of a liquid crystal display panel, the frame being displayed under a first display mode and having a plurality of frame blocks, each of which having NA vertical blocks, each of which comprising NB display lines, each of which having NC horizontal blocks, each of which being composed of a plurality of display units, each of the horizontal blocks corresponding to a horizontal block flag value, each of the display lines corresponding to a display line flag value, each of the vertical blocks corresponding to a vertical block flag value, NA, NB, and NC being positive integers, and the method comprising the steps of:

(a") obtaining the horizontal block flag value of each of the horizontal blocks according to energy levels of all of the display units in each of the horizontal blocks, wherein each of the display units has either a positive energy level or negative energy level and the horizontal block flag value of each of the horizontal blocks is obtained according to a ratio of a sum of the negative energy levels of all of the display units to a sum of the positive energy levels of all of the display units in each of the horizontal blocks;

(b") obtaining the display line flag value of each of the display lines according to the horizontal block flag values of all of the horizontal blocks in each of the display lines;

(c") obtaining the vertical block flag value of each of the vertical blocks according to the display line flag values of all of the display lines in each of the vertical blocks; and (d") determining whether or not each of the frame blocks satisfies a condition of switching the display mode according to all of the vertical block flag values in each of the vertical blocks, wherein if a fixed number of frame blocks satisfies the condition of switching the display mode, the liquid crystal display panel is switched to a second display mode.

28. The method according to claim 27, wherein the first display mode is a dot inversion display mode and the second display mode is an I-line J-dot inversion display mode, wherein I and J are positive integers.

* * * * *